United States Patent [19]

Houseman et al.

[11] 4,164,121

[45] Aug. 14, 1979

[54] CONTROL APPARATUS FOR INDUSTRIAL TRUCKS

[75] Inventors: Henry J. Houseman, Fairless Hills; Richard W. Nowicki, Penndel, both of Pa.

[73] Assignee: Eaton Corporation, Cleveland, Ohio

[21] Appl. No.: 906,725

[22] Filed: May 17, 1978

[51] Int. Cl.[2] ..... F15B 13/09; H01H 9/06

[52] U.S. Cl. ..... 60/486; 60/DIG. 2; 200/61.86; 417/426

[58] Field of Search ..... 60/428, 429, 486, DIG. 2; 74/471 R; 200/61.86, 61.88; 417/426, 3, 6, 7

[56] References Cited

U.S. PATENT DOCUMENTS 2,609,665 9/1952 Rappl ..... 60/DIG. 2

3,486,333 12/1969 Thomas ..... 60/486 X 3,910,388 10/1975 Moori et al. ..... 200/61.88

FOREIGN PATENT DOCUMENTS 979785 12/1975 Canada ..... 417/426

*Primary Examiner*—Edgar W. Geoghegan

*Attorney, Agent, or Firm*—R. J. McCloskey; F. M. Sajovec, Jr.

[57] ABSTRACT

A control mechanism for the lift cylinder of an electric lift truck. A first pump motor is energized by the closing of a first switch in response to movement of the lift valve spool toward the lift position. A second pump motor is energized when the lift valve spool is in its full lift position and a bending moment is applied to the control rod controlling the lift valve spool of sufficient magnitude to elastically deflect the control rod into closing engagement with the switch.

7 Claims, 5 Drawing Figures

CONTROL APPARATUS FOR INDUSTRIAL TRUCKS

The present invention relates to control devices, and more particularly to a pump control for an industrial truck.

In an electric forklift truck it is important to conserve electrical energy in the operation of the truck's hydraulic systems. To this end it has become common to use two motor driven pumps connected in parallel to supply pressurized oil to the hydraulic system, using only one pump under normal load conditions and providing control means to cut in the second pump only under high load conditions.

The object of the present invention is to provide a very simple and efficient control means to cut in the second pump.

In accordance with the invention a standard hydraulic control valve which includes an integral switch engageable by the valve spool to activate a first pump when the spool is moved from a neutral to an operative position, is further provided with a second switch operable by engagement with the valve spool control handle. The second switch is disposed such that it can be closed only by applying sufficient force to the control handle to deflect it beyond the position corresponding to the full open position of the valve spool. The control handle is designed such that it will not deflect sufficiently to actuate the second switch when a normal amount of force is applied to move the handle to its full on position, but will deflect sufficiently when a moderate amount of additional force is applied.

Other objects and advantages of the invention will become more apparent from the following description when taken in connection with the accompanying drawings, wherein FIG. 1 is a side elevation view of a lift truck incorporating the invention;

Figure 1:
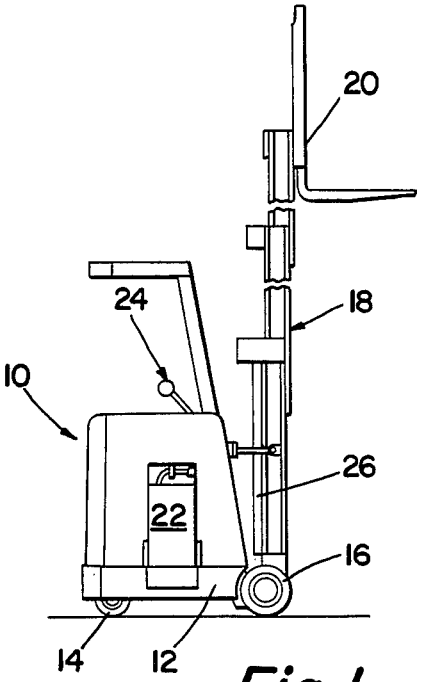

Referring to FIG. 1 there is illustrated a lift truck 10 comprising a frame 12, drive wheels 14, load wheels 16, a telescoping mast structure 18, and a load carriage 20. A battery 22 provides electric power to one or more traction motors (not shown) for driving the truck, and for the hydraulic pumps. In accordance with the invention, a control handle 24 is operatively associated with a hydraulic circuit for extending and retracting a lift cylinder 26 having a piston assembly 27, which is operatively connected to the mast structure 18 and load carriage 20 in a well-known manner. The mast and carriage structures and the connection of the lift cylinder thereto form no part of the present invention and will not be discussed in detail herein.

Figure 2:
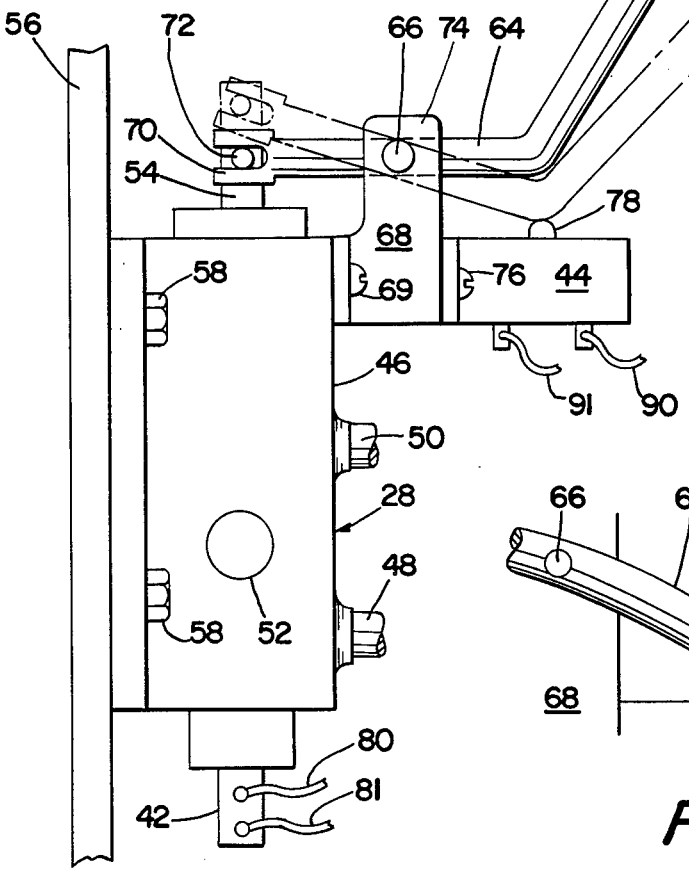
FIG. 2 is a side elevation view of the invention.
Figure 4:
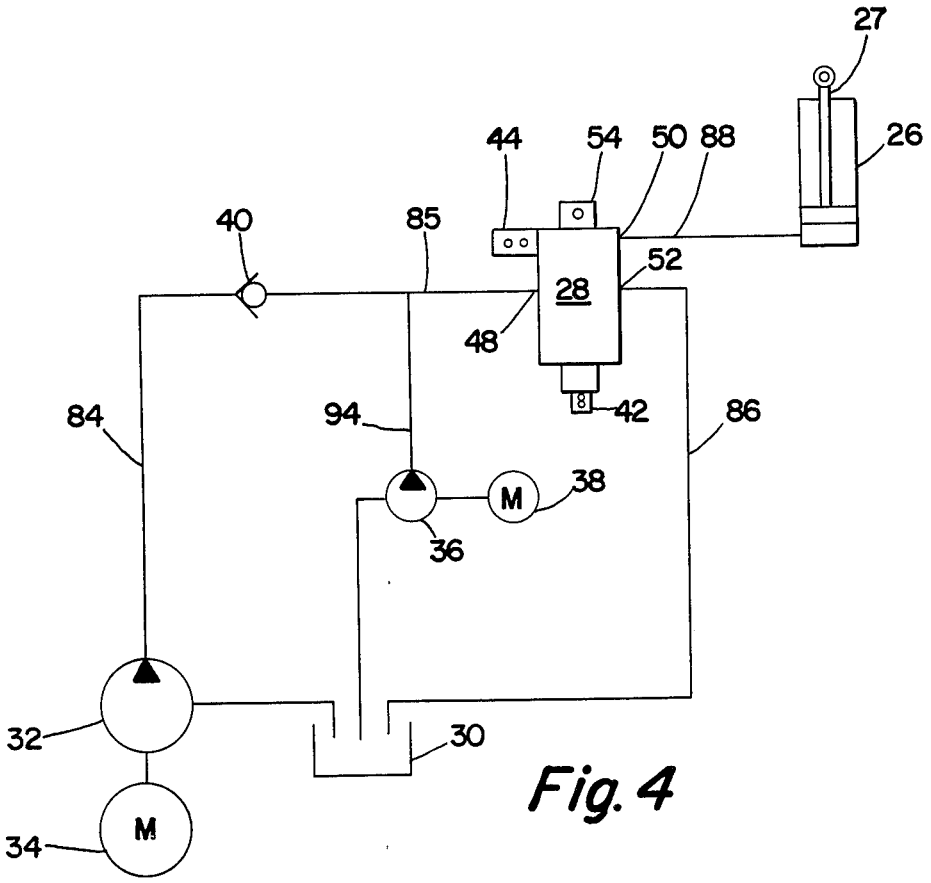
FIG. 4 is a schematic diagram of the hydraulic system of the invention.

As shown somewhat schematically in FIG. 2, the handle 24 controls a conventional hydraulic spool valve 28. In FIG. 4, the valve 28 is shown in a simplified hydraulic circuit comprising an oil sump 30, a first pump 32 driven by a first electric motor 34, a second pump 36 in parallel with the first pump and driven by a second motor 38, a check valve 40, the control valve 28, and the lift cylinder 26. It can be appreciated that in actual practice the hydraulic circuit would include other hydraulic components such as steering and tilt cylinders; however, only the lift cylinder is shown, for simplicity. It will also be apparent that while the invention control device is illustrated in connection with a lift cylinder, it could also be used in connection with other lift truck hydraulic components.

Figure 5:
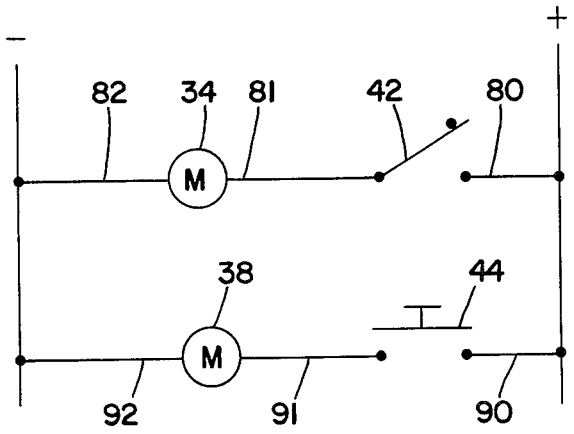
FIG. 5 is a schematic diagram of the electrical system of the invention.

Referring to FIG. 5, the first and second motors are connected to the battery 22 in parallel. First motor 34 is controlled by a first switch 42 which is mounted on the valve 24 and closed by movement of the valve spool, as will be described later, and second motor 38 is controlled by a second switch 44, which is closed by movement of the handle 24 as will be described later.

The valve 28 can be a common form of hydraulic spool valve conventionally used on lift trucks. The valve illustrated herein comprises a valve body 46, an inlet connection 48, an outlet connection 50, a drain connection 52, an axially movable spool 54, and the first switch 42. The valve assembly can be attached to a portion 56 of vehicle frame 12 by means of bolts 58. In FIG. 2 the spool 54 is illustrated in full line in its neutral position and in broken line in a first actuated position. As is well known in the art, the spool 54 controls internal valve ports such that in the neutral position oil flows from one or both of the pumps, through the valve and directly to the sump; in the first actuated position from the pump(s) to the cylinder 26; and in a second actuated position (not shown), wherein the spool is moved downward from the neutral position, from the cylinder to the sump. The switch 42 is operatively connected to the spool 54 such that the switch is closed when the spool moves from its neutral position toward its first actuated position.

The control handle 24 is generally L-shaped, having a long leg 60 with a knob 62 attached to the end thereof, and a short leg 64 which is pivotally attached at 66 to a bracket 68 fastened to the valve body 46 by means of screws 69. The end of the short leg 64 includes a forked portion 70 which fits over a pin 72 press fit into the end portion of the valve spool 54. The portion of the bracket 68 which receives the control handle 24 is substantially U-shaped when viewed from the right side of FIG. 2, with only one leg 74 shown.

The second switch 44 is shown, for ease of illustration, as being fastened to the bracket 68 by means of screws 76. The switch 44 is a normally-open, momentary contact switch including an actuating plunger 78. The switch is located such that when the control handle is rotated clockwise to its broken line position, that is, with the valve spool 54 in its full upward position, the handle will just contact the plunger 78, without moving it to its closed position. When the control handle is in the broken line position, an internal stop in the valve prevents further upward movement of the valve spool, and thus further clockwise rotation of the handle 24 about pivot 66.

Figure 3:
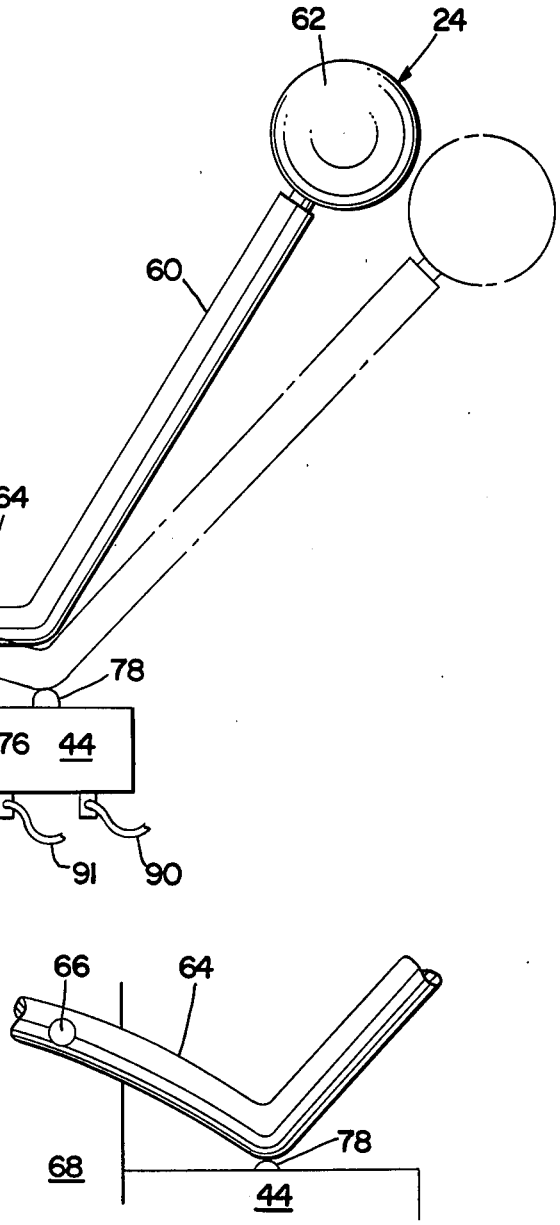
FIG. 3 is an enlarged, fragmentary side elevation view of a portion of the invention in a specific operating mode.

In order to move the plunger 78 to close the switch 44, and cut in the second pump 36, a bending moment must be applied to the handle 24 of sufficient magnitude to tend to bend the leg 64 about pivot 66 until the handle deflects sufficiently to actuate the plunger 78 as shown somewhat exaggerated in FIG. 3. The handle 24 is in the form of a solid cylindrical rod and is sized so that the leg 64 will bend elastically, thus returning to its normal configuration when the bending moment is relieved.

It can be appreciated that a number of configurations and locations for the second switch 44 can be used, which will give the desired result of having the second switch closed only when the control handle is deflected beyond a normally fully actuated position.

In operation, when the control valve is in the full line position of FIG. 2, both motor switches 42 and 44 will be open, and no oil will flow through the circuit of FIG. 4.

When the load carriage 20 is to be raised, the control handle 24 is rotated clockwise from the full line position toward the broken line position. As soon as the spool 54 starts to move upward, first switch 42 will close, completing a circuit through lines 80, 81 and 82 to the first motor 34, to activate the first pump 32. Until the active valve ports are opened by movement of the valve spool 54, oil will flow via hydraulic lines 84 and 85 to the valve 28 and directly to the sump 30 via line 86. As the valve 28 opens, flow through the valve will be directed to the lift cylinder 26 via line 88.

When the control handle 24 is in the broken line position, fully opening the valve 28, the full capacity of the first pump 32 flows to the lift cylinder 26. If a particularly heavy load is encountered under this condition, and/or increased lifting speed is required, the second pump can be cut in by deflecting the control handle 24 to actuate the switch plunger 78. When the plunger 78 is pushed in an electrical circuit is completed through lines 90, 91 and 92 to turn on the second motor 38 and activate the second pump 36. With the second pump operating, additional oil flow is provided to the lift cylinder 26 via lines 94, 85, the valve 28, and line 88.

When there is no longer a need for the additional flow of the second pump 36, the operator eases the force applied to the control handle 24 to return the handle to its undeflected condition shown in broken line. If lifting is to be stopped altogether, the handle is returned to the full line position, whereupon the first switch 42 is opened and the motor 34 stopped.

If the load carriage 20 is to be lowered, the handle 24 is rotated counterclockwise from the full line position of FIG. 2, moving the valve spool 54 downward. Under this condition, the first switch 42 is not closed; however, the spool aligns the internal valve ports so that the weight of the load will cause the oil in cylinder 26 to flow through the valve to the sump 30 via lines 88 and 86.

We claim:

1. In a hydraulic system for an industrial truck load carriage comprising a hydraulic motor operatively connected to said load carriage; a first pump having an outlet connected to said hydraulic motor; a control valve connected between said first pump outlet and said hydraulic motor, said control valve including a valve spool movable between a first position permitting no oil flow from said first pump outlet to said hydraulic motor and a second position permitting maximum oil flow from said first pump outlet to said hydraulic motor; and a second pump having an outlet connected to said hydraulic motor in parallel with the outlet of said first pump; the improvement comprising control means for activating said second pump when said valve spool is in said second position, said control means comprising a control rod operatively connected to said valve spool and movable between a first position corresponding to the first position of said valve spool and a second position corresponding to the second position of said valve spool, and switching means operatively connected to said second pump and including an operating element movable in response to movement of said control rod to activate said second pump, said operating element being moved by said control rod only when a bending moment is applied to said control rod of sufficient magnitude to deflect said control rod a predetermined amount.

2. Apparatus as claimed in claim 1, in which said hydraulic motor comprises a hydraulic cylinder having a piston element connected to said load carriage.

3. Apparatus as claimed in claim 1, in which said control valve is connected between said second pump outlet and said hydraulic motor.

4. Apparatus as claimed in claims 1, 2 or 3, including an electric motor for driving said second pump, said switching means comprising a normally open electrical switch in circuit with said electric motor which is closed in response to movement of said control rod.

5. Apparatus as claimed in claims 1, 2 or 3 including a first electric motor for driving said first pump, first electric switch means responsive to movement of said valve spool from said first position toward said second position to close an electrical circuit to said first electric motor, and a second electric motor for driving said second pump, said switching means comprising a normally open electrical switch in circuit with said second electric motor which is closed in response to movement of said control rod.

6. Apparatus as claimed in claim 5 in which said control means comprises an elongated control rod having a handle formed at one end thereof, means formed at the opposite end of said control rod for engaging said valve spool, means mounting said control rod for rotation between said first position and said second position about a pivot axis perpendicular to the longitudinal axis of said valve spool, and means mounting said second electrical switch in a position to be closed by engagement with said control rod.

7. Apparatus as claimed in claim 6, in which said means mounting said control rod comprises a bracket mounted on said control valve, and said pivot axis is defined by a pin extending through said bracket and said control rod, said bending moment being applied about said pin.

* * * * *